US005802628A

United States Patent [19]

Spoeth et al.

[11] Patent Number: 5,802,628

[45] Date of Patent: Sep. 8, 1998

[54] PRESSURE FLUSHING DEVICE DISCHARGE EXTENSION

[75] Inventors: Carl Spoeth, Bayonet Pointe, Fla.; Joseph M. Bosman, Richmond, Mich.; Dan Orlowski, Holland, Ohio; Ming Ge, Farmington Hills, Mich.

[73] Assignee: Sloan Valve Company, Franklin Park, Ill.

[21] Appl. No.: 877,105

[22] Filed: Jun. 17, 1997

[51] Int. Cl.[6] ..... E03D 3/10

[52] U.S. Cl. ..... 4/359; 4/354

[58] Field of Search ..... 4/354, 359, 360, 4/361, 362

[56] References Cited

U.S. PATENT DOCUMENTS 4,233,698 11/1980 Martin ..... 4/354

5,361,426 11/1994 Martin ..... 4/361

*Primary Examiner*—Robert M. Fetsuga

*Attorney, Agent, or Firm*—Dorn, McEachran, Jambor & Keating

[57] ABSTRACT

A pressure flush system for use within a toilet tank includes a pressure flush tank which has an air inlet and a water inlet. Water is maintained with the pressure flush tank under air pressure. There is a water discharge for said tank to direct water to a toilet bowl. The tank contains a flushing valve system, which, when operated, will direct water under air pressure through said water discharge opening. The water discharge includes a housing which is attached to the bottom of the pressure flush tank and there is a one way check valve in the water discharge housing and located outside of the pressure flush tank. The one way check valve prevents water passing therethrough when the pressure flush tank is discharged and it permits the draining of water outside of the pressure flush tank and within the toilet tank through the water discharge opening.

9 Claims, 2 Drawing Sheets

60
64
62
66
14
68
70
54
72
32
30
38
52
50
48
44
34
40
86
42
36
82
46
84
80

36
86
88
106
102
100
94
96
84
98
82
92
90
103
80
88
94
90
96
92

101
104
101
100
102
98
103

88
92
94
90
106
106

101
104
101
98
102
103
100

PRESSURE FLUSHING DEVICE DISCHARGE EXTENSION

THE FIELD OF THE INVENTION

This invention relates to pressure flush tanks or pressure flush systems of the type disclosed in U.S. Pat. No. 4,233,698, owned by the assignee of the present application, Sloan Valve Company of Franklin Park, Ill. In particular, the invention relates to an improved discharge or drain for such a pressure flush tank which both prevents splashing of water into the toilet tank when the pressure tank is discharged and permits the draining of the toilet tank if water should accumulate therein over a period of time.

SUMMARY OF THE INVENTION

The present invention relates to pressure flush tanks and in particular to an improved drain or discharge for such tanks.

A primary purpose of the invention is a pressure flush tank as described which includes a one way check valve, located outside of the pressure flush tank, but within the toilet tank.

Another purpose of the invention is to provide a drain for the environment described which prevents water splashing into the toilet tank, but provides a means for draining water which may accumulate within the toilet tank.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The present invention relates to pressure flush tanks for toilets of the type disclosed in U.S. Pat. No. 4,233,698, owned by Sloan Valve Company of Franklin Park, Ill., the assignee of the present application. The '698 patent disclosure is herein incorporated by reference.

Figure 1:
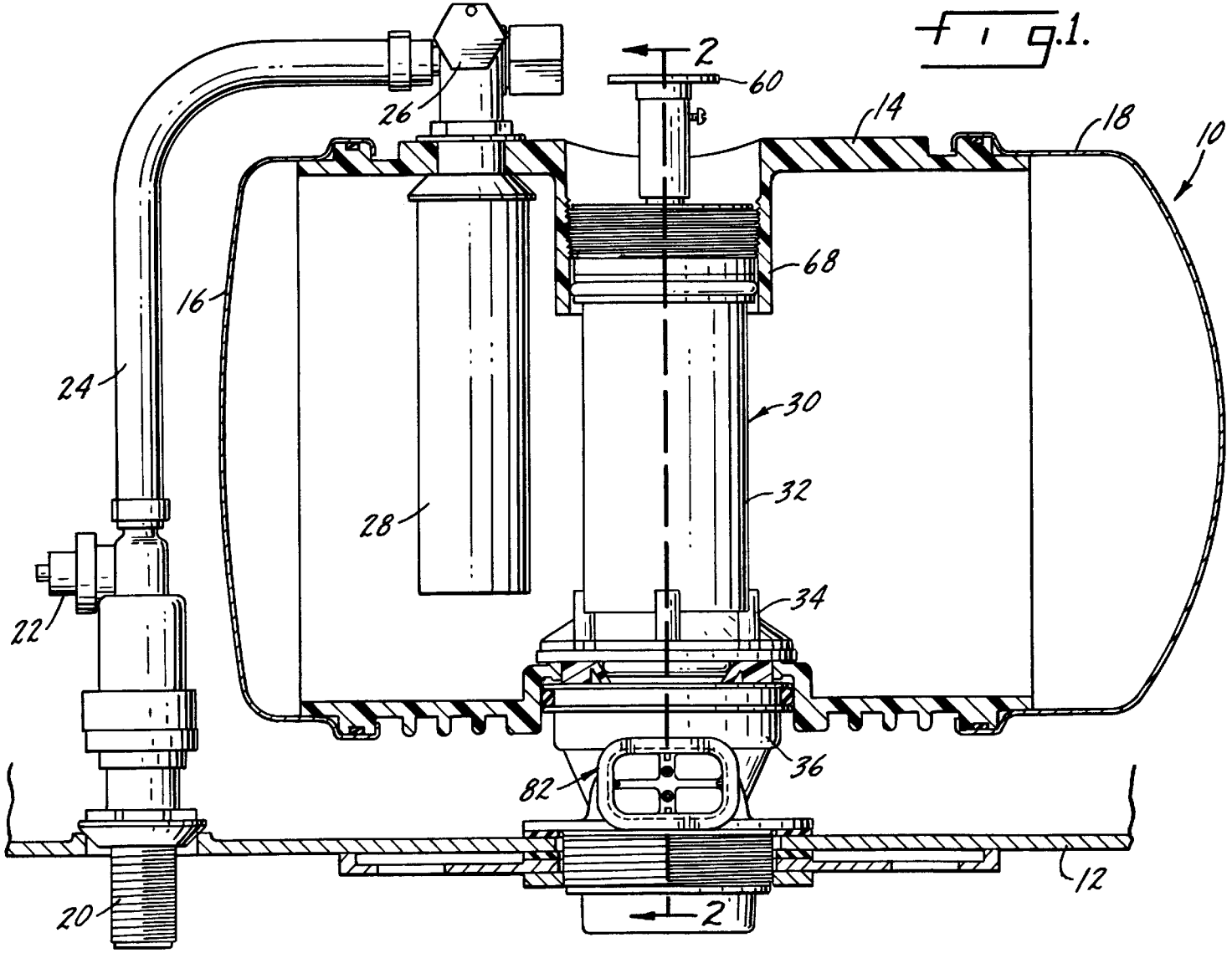
FIG. 1 is a side view, in part section, illustrating a pressure flush tank as mounted within a toilet tank.

In FIG. 1 there is disclosed a pressure flush tank indicated generally at 10 which will be positioned within the toilet tank, a portion of which is shown at 12. The purpose of the pressure flush tank is to provide a measured quantity or volume of water, under pressure so that the flushing system may be more effective but yet use a volume of water consistent with current government regulations.

The tank 10 may include a central cylindrical portion 14 and end caps 16 and 18. The water inlet for the tank 10 is through a conduit 20 which may have a suitable shut-off valve 22 connected thereto. From the shut-off valve there is a further conduit 24 which is connected to an air inducer housing 26. The air inducer housing, as shown in the '698 patent is effective to permit the passage of water from conduit 24 downwardly through interior tube 28 while drawing air therethrough with the end result that the tank 10 will have a measured quantity of water with air under pressure above the water within the tank. The flow of water from conduit 24 toward tube 28 will open the air inducer air passage as described in the '698 patent so that both air and water will enter the interior of the tank 10.

Figures 2, 3, 4, 5, 6, 7:
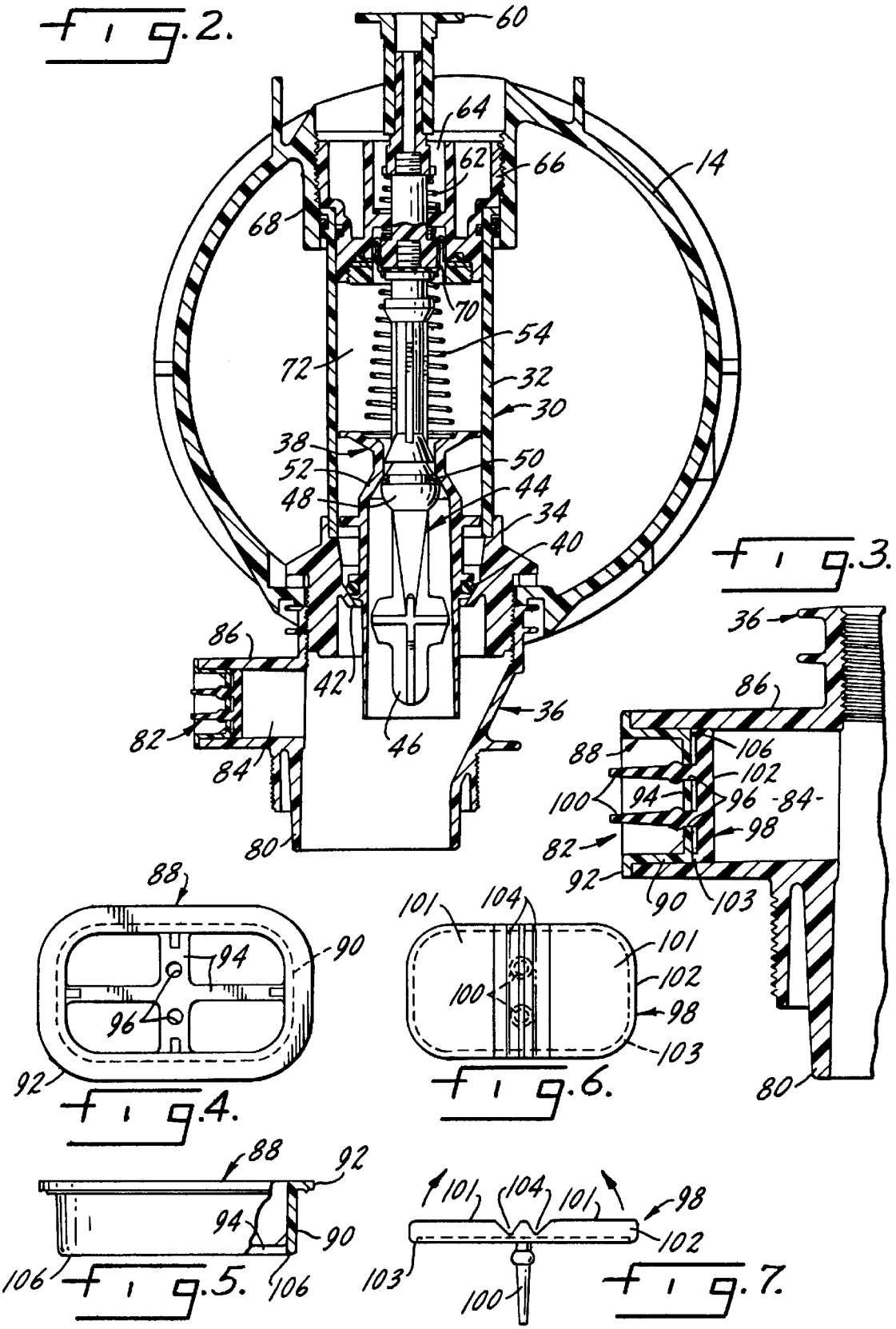
FIG. 2 is a section along plane 2—2 of FIG. 1.
FIG. 3 is an enlarged section illustrating the pressure flush drain and the check valve mounted therein.
FIG. 4 is a front view of the check collar.
FIG. 5 is a bottom view, in part section, of the check valve collar.
FIG. 6 is a rear view of the flapper portion of the check valve.
FIG. 7 is bottom view of the flapper portion of the check valve.

As shown in FIG. 1 centrally located within the tank 10 is a discharge assembly indicated generally at 30 and shown in detail in FIG. 2.

The discharge assembly 30 includes a housing 32, the lower end of which fits within a groove in a discharge adaptor 34. The adaptor 34 is threadedly engaged with the drain housing 36 which will be described in detail hereinafter.

Positioned within the housing 32 and the discharge adaptor 34 is a flush valve 38 carrying an O-ring 40 which forms a water closing seal with a lip 42 of the adaptor 34. Positioned within the flush valve 38 is a fluted control valve stem 44 having a lower portion 46 with a series of fins and a generally central enlarged portion 48 carrying an O-ring 50 which may seal against an inturned portion 52 of the flush valve 38. A spring 54 biases the control valve stem 48 in an upward direction as the bottom of the spring seats upon flush valve 38 with the upper end of the spring urging the control valve stem in an upward direction.

There is a manual operating member 60 which extends outside of the tank 10 and is held in the up position by a coil spring 62 mounted within a chamber 64 of a control valve support ring 66. The support ring 66 is threadedly mounted in a boss 68 formed integrally with the central portion 14 of the tank 10. Suitable seal rings are used to insure that water does not escape outwardly through this entrance to the tank.

In operation, the tank 10 will initially be filled with water under pressure with the air being compressed in the volume above the water. The pressure within sleeve 32 above valve 38 will hold the valve downwardly so that seal 40 will close upon the discharge end of adaptor 34. The top of tube 32 is additionally closed by a diaphragm seal 70 connected between the upper end of control valve stem 52 and the control valve support ring 66. When the manual valve operating member 60 is pushed downwardly against the force of its spring 62, the valve 48 will be moved away from its seat so that fluid, both air and water which are within the chamber 72 formed by tube 32 and pass down through the open lower end of valve 38 to the discharge opening adaptor. Water within tank 10 will then enter the sleeve 32 through openings not shown herein, but illustrated in the above referenced '698 patent with the result that the water within the tank will be rapidly discharged through the bottom of the tank.

The present invention is particularly concerned with the drain or discharge member 36. It is important in pressure flush systems of the type described that there be no accumulated water within the toilet tank 12. In effect it is desired to have a dry tank. To have a dry toilet tank it is necessary that no water be splashed into the toilet tank as the pressure flush system is utilized and also that any accumulated moisture within the toilet tank be easily drained. Such is provided by the drain member 36.

Drain member 36 includes a housing 80 having a one-way check valve indicated generally at 82. The check valve 82 includes an opening 84 into the central passage of the drain and a generally cylindrical extension 86. A cap 88 fits within the extension 86 and the cap 88 may have a rectangular outer sleeve 90 with rounded corners, a lip 92 which bears against the end of extension 86 and a generally cross shaped support member 94, shown particularly in FIG. 4. The cross shaped support member 94 has two openings 96.

The closure for the check valve is formed by a flexible rubber-like closure member 98 which has two outwardly extending projections 100 which fit within the openings 96 in the cap 88. The projections 100 attach the closure member 98 to the cap. The closure member 98 has a single somewhat rectangular shaped portion 102 with rounded corners. Since the member 98 is flexible, and since it is attached to the support member 94 through the openings 96, there are two effective integral flaps 101 formed by the portion 102. The flaps 101 are joined at two living hinges 104 located generally in alignment with the projections 100.

When water is passing downwardly through the drain 36, this water will be under substantial pressure and will effectively urge the outer peripheral lip 103 of the portion 102 firmly against the interior support surface 106 of the cap 90. This effectively closes the check valve preventing any water from splashing outwardly into the toilet tank during a pressure flush operation. If water should accumulate within the toilet tank, and this pressure builds up to any appreciable level, that water will push against the flaps 101, which are flexible, and will open the check valve permitting water within the toilet tank to drain down through the drain housing 80.

Although the member 98 is a single integral element, there are two effective flaps 101 formed by the living hinges 104 located generally at the center of member 98. The flaps 101 may be urged against the seal closing surface 106 when water is passing downwardly through the drain or may be urged away from that surface when there is water at an appreciable level within the toilet tank to thereby drain water within the tank maintaining it in a dry condition.

Whereas the preferred form of the invention has been shown and described herein, it should be realized that there may be many modifications, substitutions and alterations thereto.

The embodiments of the invention in which an exclusive property or privilege is claimed are defined as follows:

1. A pressure flush system for use within a toilet tank including a pressure flush tank, an air inlet for said pressure flush tank, a water inlet for said pressure flush tank, with said pressure flush tank, prior to discharge, containing water under pressure, value means within said pressure flush tank a water discharge for said pressure flush tank to direct water to a toilet bowl, said water discharge including a housing attached to said pressure flush tank, and a one way check valve in said water discharge housing and outside of said pressure flush tank, said one way check valve preventing water passing therethrough and into the toilet tank when said pressure flush tank is discharged, said one way check valve permitting draining of water outside of said pressure flush tank and within the toilet tank through said water discharge housing.

2. The pressure flush system of claim 1 wherein said one way check valve includes an opening in said water discharge housing, and at least one flexible flap normally closing said opening.

3. The pressure flush system of claim 2 wherein said one way check valve includes a plurality of flexible flaps normally closing said opening.

4. The pressure flush system of claim 3 wherein said water discharge housing opening has at least one support member positioned therein, with said support member mounting said flexible flaps.

5. The pressure flush system of claim 4 wherein said flexible flaps are formed of a single integral flexible member attached to said support member.

6. The pressure flush system of claim 5 wherein said support member is generally centrally located in said discharge housing opening.

7. The pressure flush system of claim 5 wherein said support member has at least one opening, said flexible member having a projection positioned within said opening to attach said flexible member having a projection positioned within said opening to attach said flexible member to said cap.

8. The pressure flush system of claim 4 including a cap attached to said water discharge housing opening, said support member being a part of said cap.

9. The pressure flush system of claim 8 wherein said flexible member has a peripheral lip normally closed upon said cap.

* * * * *